US008773339B2

(12) United States Patent
Kim et al.

(10) Patent No.: US 8,773,339 B2
(45) Date of Patent: Jul. 8, 2014

(54) METHOD OF DRIVING DISPLAY PANEL AND DISPLAY APPARATUS FOR PERFORMING THE SAME

(75) Inventors: Young-Su Kim, Daegu (KR); Jae-Hoon Lee, Seoul (KR); Chang-Ho Lee, Seoul (KR); Yu-Han Bae, Seoul (KR)

(73) Assignee: Samsung Display Co., Ltd. (KR)

( * ) Notice: Subject to any disclaimer, the term of this patent is extended or adjusted under 35 U.S.C. 154(b) by 525 days.

(21) Appl. No.: 13/209,521

(22) Filed: Aug. 15, 2011

(65) Prior Publication Data

US 2012/0162184 A1 Jun. 28, 2012

(30) Foreign Application Priority Data

Dec. 24, 2010 (KR) ..... 10-2010-0134363

(51) Int. Cl.
*G09G 5/00* (2006.01)

(52) U.S. Cl.
USPC ..... 345/87; 345/88; 345/89; 345/90; 345/91; 345/92; 345/93; 345/94; 345/95; 345/96; 345/97; 345/98; 345/99; 345/100; 345/101; 345/102; 345/103; 345/104; 345/690; 345/211; 345/212; 345/213

(58) Field of Classification Search
USPC ..... 345/87–104, 690, 211–213
See application file for complete search history.

(56) References Cited

U.S. PATENT DOCUMENTS

| | | | | |
|---|---|---|---|---|
| 7,015,903 | B2 | 3/2006 | Lee | |
| 7,671,853 | B2 * | 3/2010 | Morita | 345/211 |
| 2010/0134473 | A1 | 6/2010 | Matsuda et al. | |
| 2012/0162184 | A1 * | 6/2012 | Kim et al. | 345/212 |

FOREIGN PATENT DOCUMENTS

| | | | |
|---|---|---|---|
| JP | 10-319914 | A | 12/1998 |
| KR | 10-2008-0062926 | A | 7/2008 |

* cited by examiner

*Primary Examiner* — Alexander S Beck
*Assistant Examiner* — Jeffrey Steinberg
(74) *Attorney, Agent, or Firm* — Cantor Colburn LLP

(57) ABSTRACT

A method of driving a display panel includes applying a common voltage to the display panel, sensing a frequency of the display panel to generate a frequency signal, adjusting a gain of an operational amplifier based on the frequency signal, receiving a feedback common voltage from the display panel, and compensating the common voltage using an input resistor, the operational amplifier and a feedback resistor based on the feedback common voltage to apply the compensated common voltage to the display panel. The operational amplifier includes an inverting input terminal connected to the input resistor, a non-inverting input terminal to which a reference common voltage is applied and an output terminal. The feedback resistor is between the inverting input terminal and the output terminal.

20 Claims, 4 Drawing Sheets

METHOD OF DRIVING DISPLAY PANEL AND DISPLAY APPARATUS FOR PERFORMING THE SAME

This application claims priority to Korean Patent Application No. 2010-0134363, filed on Dec. 24, 2010 and all the benefits accruing therefrom under 35 U.S.C. §119, the contents of which are herein incorporated by reference in their entireties.

BACKGROUND OF THE INVENTION

1. Field of the Invention

Exemplary embodiments of the invention relate to a method of driving a display panel, and a display apparatus for performing the method. More particularly, exemplary embodiments of the invention relate to a method of driving a display panel improving a display quality, and a display apparatus for performing the method.

2. Description of the Related Art

Generally, a liquid crystal display ("LCD") apparatus includes a first substrate including a pixel electrode, a second substrate including a common electrode, and a liquid crystal layer disposed between the first and second substrates. When a grayscale voltage is applied to the pixel electrode, and a common voltage is applied to the common electrode, an electric field is generated at the liquid crystal layer. When an intensity of the electric field is adjusted, a light transmittance of the liquid crystal layer is adjusted. Thus, a desired image may be displayed on a liquid crystal display panel.

In order to display the desired image accurately, the common voltage should be maintained in a uniform level in spite of a change of the grayscale voltage. However, the common voltage ripples according to a change of the grayscale voltage. Due to the ripple of the common voltage, a cross talk effect may be caused thereby causing deterioration of a display quality of the display panel.

A compensating circuit using a feedback system may be employed to compensate the ripple of the common voltage. The compensating circuit may include an operational amplifier.

Generally, a gain of the operational amplifier is fixed in a predetermined value so that the ripple of the common voltage is not adequately compensated when a frequency of the liquid crystal display panel is varied.

BRIEF SUMMARY OF THE INVENTION

Exemplary embodiments of the invention provide a method of driving a display panel compensating a common voltage according to a frequency of a display panel to improve a display quality.

Exemplary embodiments of the invention also provide a display apparatus for performing the above-mentioned method.

In an exemplary method of driving a display panel according to the invention, the method includes applying a common voltage to the display panel, sensing a frequency of the display panel to generate a frequency signal, adjusting a gain of an operational amplifier based on the frequency signal, receiving a feedback common voltage from the display panel, and compensating the common voltage using an input resistor, the operational amplifier and a feedback resistor based on the feedback common voltage to apply the compensated common voltage to the display panel. The operational amplifier includes an inverting input terminal connected to the input resistor, a non-inverting input terminal to which a reference common voltage is applied and an output terminal. The feedback resistor is between the inverting input terminal and the output terminal.

In an exemplary embodiment, the adjusting a gain of an operational amplifier may include selecting one of a plurality of input resistors based on the frequency signal.

In an exemplary embodiment, the selected input resistor may have a relatively low resistance when the frequency of the display panel is relatively high In an exemplary embodiment, the adjusting a gain of an operational amplifier may include connecting a switch input terminal, to which the feedback common voltage is applied, to a switch output terminal when the frequency signal represents ON value applied to an enable terminal.

In an exemplary embodiment, the adjusting a gain of an operational amplifier may include selecting one of a plurality of feedback resistors based on the frequency signal.

In an exemplary embodiment, the selected feedback resistor may have a relatively high resistance when the frequency of the display panel is relatively high In an exemplary embodiment, the adjusting a gain of an operational amplifier may include connecting a switch input terminal, to which the feedback common voltage is applied, to a switch output terminal when the frequency signal represents ON value applied to an enable terminal.

In an exemplary embodiment, the method may further include providing the feedback common voltage from a storage electrode of the display panel.

In an exemplary embodiment, the method may further include the display panel may selectively displaying a two-dimensional image and a three-dimensional image In an exemplary embodiment, the frequency of the display panel may be about 60 Hertz (Hz) or about 120 Hz when the display panel displays the two-dimensional image. The frequency of the display panel may be about 175 Hz when the display panel displays the three-dimensional image.

In an exemplary display apparatus according to the invention, the display apparatus includes a display panel, a frequency sensor, a common voltage compensating part and a switching part. The display panel displays an image. The frequency sensor senses a frequency of the display panel to generate a frequency signal based on the sensed frequency. The common voltage compensating part includes an input resistor, an operational amplifier and a feedback resistor. The common voltage compensating part receives a feedback common voltage from the display panel to compensate the common voltage. The operational amplifier includes an inverting input terminal connected to the input resistor, a non-inverting input terminal to which a reference common voltage is applied, and an output terminal. The feedback resistor is between the inverting input terminal and the output terminal.

In an exemplary embodiment, the switching part may select one of a plurality of input resistors based on the frequency signal.

In an exemplary embodiment, the selected input resistor may have a relatively low resistance when the frequency of the display panel is relatively high.

In an exemplary embodiment, the switching part may include an enable terminal, a switch input terminal and a switch output terminal. The frequency signal may be applied to the enable terminal. The feedback common voltage may be applied to the switch input terminal. The switch input terminal may be connected to the switch output terminal when the frequency signal represents ON value.

In an exemplary embodiment, the switching part may select one of a plurality of feedback resistors based on the frequency signal.

In an exemplary embodiment, the selected feedback resistor may have a relatively high resistance when the frequency of the display panel is relatively high.

In an exemplary embodiment, the switching part may include an enable terminal, a switch input terminal and a switch output terminal. The frequency signal may be applied to the enable terminal. The feedback common voltage may be applied to the switch input terminal. The switch input terminal may be connected to the switch output terminal when the frequency signal represents ON value.

In an exemplary embodiment, the display panel may include a first substrate and a second substrate. The first substrate may include a pixel electrode and a storage electrode. The second substrate may include a common electrode. The feedback common voltage is provided from the storage electrode to the common voltage compensating part.

In an exemplary embodiment, the display panel may selectively display a two-dimensional image and a three-dimensional image In an exemplary embodiment, the frequency of the display panel may be about 60 Hz or about 120 Hz when the display panel displays the two-dimensional image. The frequency of the display panel may be about 175 Hz when the display panel displays the three-dimensional image.

According to the exemplary embodiments of a method of driving a display panel and a display apparatus for performing the method, a common voltage is compensated according to a frequency of a display panel so that a display quality of the display panel may be improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION OF THE INVENTION

Figure 1:
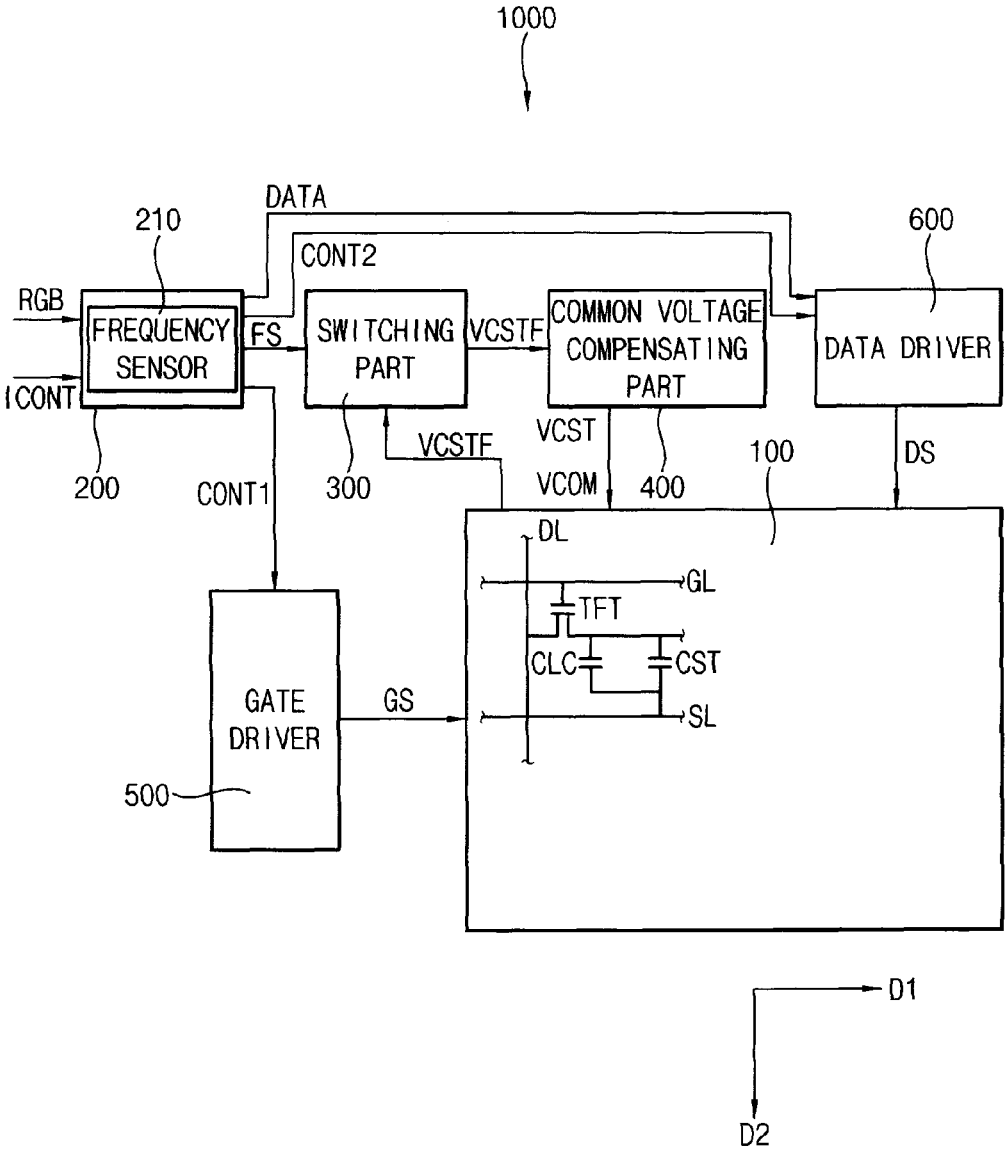
FIG. 1 is a block diagram illustrating an exemplary embodiment of a display apparatus according to the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "applied to" another element or layer, the element or layer can be directly on, connected or applied to another element or layer or intervening elements or layers. In contrast, when an element is referred to as being "directly on," "directly connected to" or "directly applied to" another element or layer, there are no intervening elements or layers present. As used herein, "connected" includes physically and/or electrically connected. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be explained in detail with reference to the accompanying drawings.

FIG. 1 is a block diagram illustrating an exemplary embodiment of a display apparatus according to the invention.

Referring to FIG. 1, the display apparatus 1000 includes a display panel 100, a timing controller 200, a switching part 300, a common voltage compensating part 400, a gate driver 500 and a data driver 600.

The display panel 100 includes a plurality of gate lines GL, a plurality of data lines DL and a plurality of pixels electrically connected to the gate lines GL and the data lines DL. The gate lines GL longitudinally extend in a first direction D1, and the data lines DL longitudinally extend in a second direction D2 crossing the first direction D1. In one exemplary embodiment, for example, the second direction D2 may be substantially perpendicular to the first direction D1. Accordingly, the data lines DL may longitudinally extend in a direction substantially perpendicular to the gate line GL.

The display panel 100 may further include a plurality of storage lines SL. The storage lines SL may longitudinally extend in the first direction D1. Accordingly, the storage lines SL may longitudinally extend in a direction substantially parallel to the gate lines GL.

Each pixel includes a switching element TFT electrically connected to a gate line GL of the plurality of gate lines GL and a data line DL of the plurality of data lines DL, a liquid crystal capacitor CLC and a storage capacitor CST which are electrically connected to the switching element TFT. The pixels are arranged in a matrix form.

In one exemplary embodiment, for example, the switching element TFT may be a thin film transistor. The switching element TFT may include a gate electrode, a source electrode and a drain electrode. The gate electrode may be electrically connected to the gate line GL, the source electrode may be electrically connected to the data line DL, and the drain electrode may be electrically connected to a first end of the liquid crystal capacitor CLC and a first end of the storage capacitor CST.

The display panel 100 includes a first substrate including a pixel electrode, and a second substrate including a common electrode.

The first substrate includes the switching element TFT, the gate line GL, the data line DL, the storage line SL, the pixel electrode (not shown) and a storage electrode (not shown). The second substrate includes a common electrode (not shown). The second substrate may further include a color filter (not shown).

The liquid crystal capacitor CLC is defined by the pixel electrode of the first substrate, and the common electrode of the second substrate. The storage capacitor CST is defined by the pixel electrode and the storage electrode. Alternatively, the storage capacitor CST may be defined by the source and drain electrodes of the switching element TFT, and the storage electrode.

The storage line SL is electrically connected to the storage electrode defining the storage capacitor CST to apply a first common voltage VCST to the storage electrode.

In addition, a second common voltage VCOM may be applied to the common electrode of the second substrate through a connecting part electrically connecting the first substrate and the second substrate to each other.

The display panel 100 may be selectively display a two-dimensional image and a three-dimensional image. In one exemplary embodiment, for example, when the display panel 100 displays the two-dimensional image, a frequency of the display panel 100 may be about 60 Hertz (Hz) or about 120 Hz. When the display panel 100 displays the three-dimensional image, a frequency of the display panel 100 may be about 175 Hz.

In FIG. 1, even though the second common voltage VCOM is applied to the common electrode through the storage line SL, the second common voltage VCOM may be applied to the common electrode without using the storage line SL.

The first common voltage VCST may be substantially the same as the second common voltage VCOM.

The timing controller 200 receives an input image data RGB and an input control signal ICONT from an external apparatus (not shown).

The input image data may include a red image data R, a green image data G and a blue image data B. The input control signal ICONT may include a master clock signal, a data enable signal, a vertical synchronizing signal and a horizontal synchronizing signal.

The timing controller 200 generates a first control signal CONT1, a second control signal CONT2 and a data signal DATA based on the input image data RGB and the input control signal ICONT.

The timing controller 200 generates the first control signal CONT1 for controlling a driving timing of the gate driver 500 based on the input control signal ICONT, and outputs the first control signal CONT1 to the gate driver 500.

The timing controller 200 generates the second control signal CONT2 for controlling a driving timing of the data driver 600 based on the input control signal ICONT, and outputs the second control signal CONT2 to the data driver 600. The timing controller 200 processes the input image data RGB to generate the data signal DATA, and outputs the data signal DATA to the data driver 600.

The first control signal CONT1 may include a vertical start signal and a gate clock signal. The second control signal CONT2 may include a horizontal start signal and a load signal.

The timing controller 200 includes a frequency sensor 210 sensing a frequency of the display panel 100. The frequency sensor 210 senses the frequency of the display panel 100, to generate a frequency signal FS. The frequency sensor 210 outputs the frequency signal FS to the switching part 300.

The frequency sensor 210 may include a counter to determine the frequency of the display panel 100. The counter may count the load signal of the data driver 600 to determine the frequency of the display panel.

The frequency signal FS may represent a value of the frequency of the display panel 100. In one exemplary embodiment, for example, when the frequency of the display panel 100 is about 120 Hz, the frequency signal FS may store the value 120.

Alternatively, the frequency signal FS may represent ON and OFF values. The frequency signal FS may include a plurality of frequency signals respectively representing ON and OFF values.

In one exemplary embodiment, for example, the plurality of frequency signals may include a first frequency signal, a second frequency signal and a third frequency signal. When the frequency of the display panel 100 is a first frequency, the first frequency signal represents ON value. When the frequency of the display panel 100 is not the first frequency, the first frequency signal represents OFF value. When the frequency of the display panel 100 is a second frequency, the second frequency signal represents ON value. When the frequency of the display panel 100 is not the second frequency, the second frequency signal represents OFF value. When the frequency of the display panel 100 is a third frequency, the third frequency signal represents ON value. When the frequency of the display panel 100 is not the third frequency, the third frequency signal represents OFF value.

When the display panel 100 selectively displays a two-dimensional image and a three-dimensional image, the frequency signal FS may be a three dimension enable signal.

In the illustrated exemplary embodiment explained referring to FIG. 1, though the frequency sensor 210 is included in the timing controller 200, the frequency sensor 210 may be an independent element separate from the timing controller 200.

The switching part 300 receives the frequency signal FS from the frequency sensor 210. A feedback common voltage VCSTF is applied from the display panel 100 to the switching part 300. The switching part 300 adjusts a gain of an operational amplifier of the common voltage compensating part 400 based on the frequency signal FS. An operation of the switching part 300 is explained in detail referring to FIGS. 2 to 4.

The common voltage compensating part 400 includes a plurality of input resistors. One of the input resistors of the common voltage compensating part 400 is selected by the switching part 300. The feedback common voltage VCSTF from the switching part 300 is applied to the common voltage compensating part 400 through the selected input resistor.

The common voltage compensating part 400 compensates the common voltages VCST and VCOM using the input resistor, the operational amplifier and a feedback resistor. The common voltage compensating part 400 outputs the compensated common voltages VCST and VCOM to the display panel 100. An operation of the common voltage compensating part 400 is explained in detail referring to FIGS. 2 and 3.

The gate driver 500 generates gate signals GS driving the gate lines GL in response to the first control signal CONT1 received from the timing controller 200. The gate driver 500 sequentially outputs the gate signals GS to the gate lines GL.

The gate driver 500 may be a separate element directly on the display panel 100, or may be connected to the display panel 100 as a tape carrier package ("TCP") type. Alternatively, the gate driver 500 may not be a separate element and may be integrated on the display panel 100.

The data driver 600 receives the second control signal CONT2 and the data signal DATA from the timing controller 200, and generates data voltages DS having an analog type. The data driver 600 sequentially outputs the data voltages DS to the data lines DL.

The data driver 600 may convert the data signal DATA into the data voltages DS using a gamma reference voltage. The gamma reference voltage may have values corresponding to the data voltages DS respectively.

The gamma reference voltage may be generated by a gamma voltage generator (not shown). The gamma voltage generator may be in the timing controller 200 or in the data driver 600. Alternatively, the gamma voltage generator may an independent element from the timing controller 200 and the data driver 600.

The data driver 600 may include a shift register (not shown), a latch (not shown), a signal processor (not shown) and a buffer (not shown). The shift register outputs a latch pulse to the latch. The latch temporarily store the data signal DATA, and outputs the data signal DATA. The signal processor converts the data signal DATA having an analog type into the data voltages DS having a digital type to output the data voltages DS to the buffer. The buffer compensates the data voltages DS to have a uniform level, and outputs the data voltages DS to the data lines DL.

The data driver 600 may be a separate element directly on the display panel 100, or may be connected to the display panel 100 in a TCP type. Alternatively, the data driver 600 may not be a separate element and may be integrated on the display panel 100.

Figure 2:
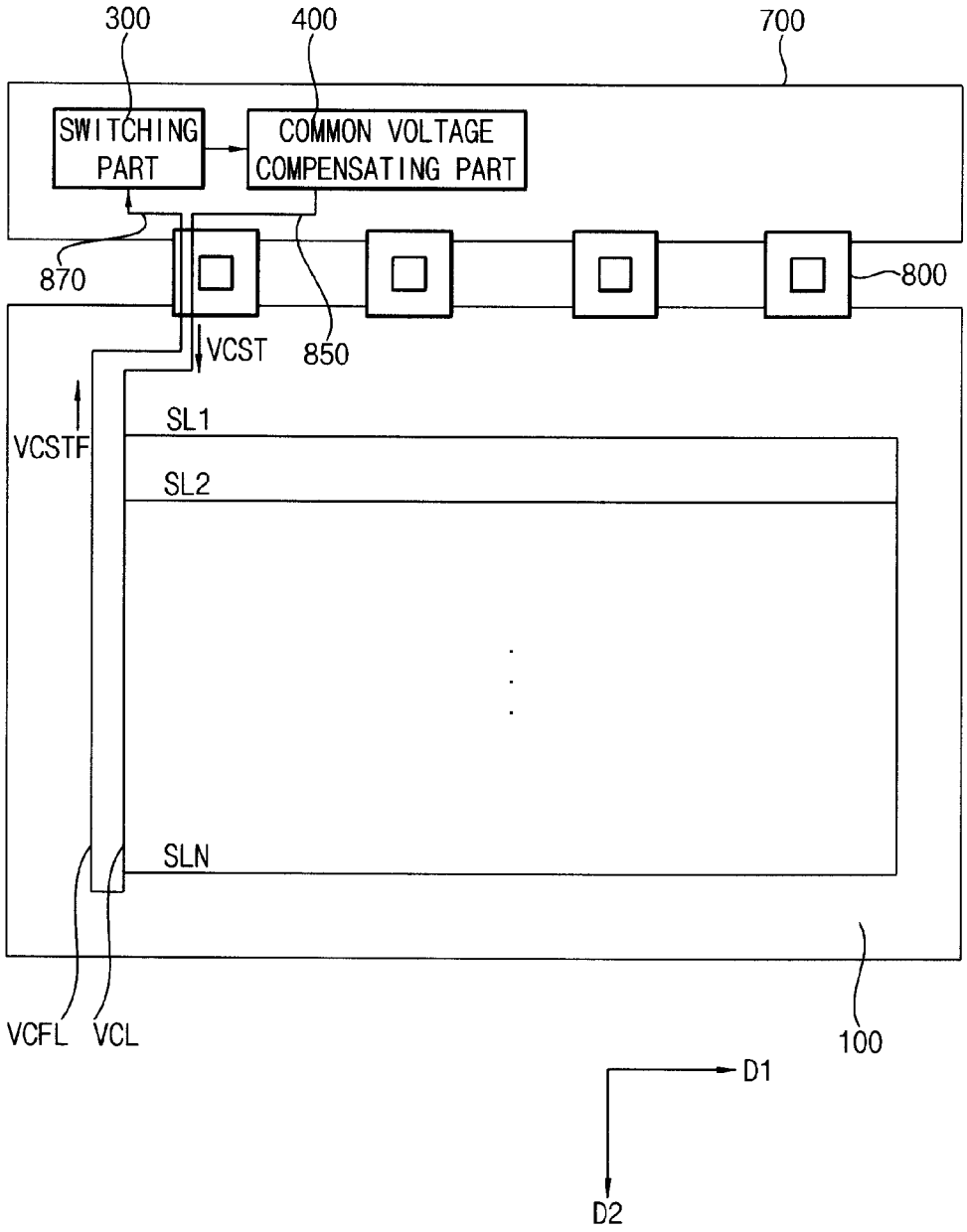
FIG. 2 is a plan view illustrating the display apparatus of FIG. 1 to represent a transmitting path of a first common voltage.

FIG. 2 is a plan view illustrating the display apparatus of FIG. 1 to represent a transmitting path of the first common voltage VCST. In FIG. 2, the timing controller 200, the gate driver 500 and the data driver 600 are omitted for convenience of explanation. In addition, the gate line GL, the data line DL, the switching element TFT, the liquid crystal capacitor CLC and the storage capacitor CST on the display panel 100 are omitted for convenience of explanation.

Referring to FIGS. 1 and 2, the display panel 100 includes a common voltage applying line VCL, a common voltage feedback line VCFL and a plurality of storage lines SL1 to SLN.

The common voltage applying line VCL may longitudinally extend in the second direction D2. A first end of the common voltage applying line VCL may be electrically connected to the common voltage compensating part 400. A second end of the common voltage applying line VCL opposite to the first end may be electrically connected to the common voltage feedback line VCFL.

The common voltage feedback line VCFL may longitudinally extend in the second direction in parallel with the common voltage applying line VCL. A first end of the common voltage feedback line VCFL may be eclectically connected to the switching part 300. A second end of the common voltage feedback line VCFL opposite to the first end may be electrically connected to the common voltage applying line VCL.

The display panel 100 may include N storage lines SL1 to SLN. Herein, N is a natural number. In one exemplary embodiment, for example, when a resolution of the display panel 100 is 1920×1080, N may be 1080. Alternatively N may be greater than 1080.

First ends of the storage lines SL1 to SLN are electrically connected to the common voltage applying line VCL. The storage lines SL1 to SLN are electrically connected to the storage electrodes in the pixels. Second ends of the storage lines SL1 to SLN opposite to the first ends may be electrically connected to each other.

The switching part 300 and the common voltage compensating part 400 may be on a printed circuit board ("PCB") 700. In an exemplary embodiment of manufacturing the display apparatus 1000, the switching part 300 and the common voltage compensating part 400 may be formed on the PCB 700 on which is the data driver 600 is formed.

The PCB, including the switching part 300 and the common voltage compensating part 400 may be connected to the display panel 100 through a flexible printed circuit board 800 as shown in FIG. 2.

Hereinafter, the transmitting path of the first common voltage VCST may be explained in detail.

The common voltage compensating part 400 applies the first common voltage VCST to the display panel 100. The first common voltage VCST is transmitted to the common voltage applying line VCL of the display panel 100 through a first signal transmitting line 850 partially overlapping the flexible printed circuit board 800.

The common voltage applying line VCL transmits the first common voltage VCST to the storage lines SL1 to SLN. The first common voltage VCST is applied to the storage electrodes connected to the storage lines SL1 to SLN.

The common voltage feedback line VCFL is connected to the common voltage applying line VCL so that the first common voltage VCST is fed back from the storage electrodes to the common voltage feedback line VCFL. The voltage transmitted to the common voltage feedback line VCFL may be called as a feedback common voltage VCSTF for convenience of explanation.

The common voltage feedback line VCFL transmits the feedback common voltage VCSTF to the switching part 300 through a second signal transmitting line 870 partially overlapping the flexible printed circuit board 800.

Hereinafter, although not shown in figures, a transmitting path of the second common voltage VCOM is briefly explained.

The common voltage compensating part 400 applies the second common voltage VCOM to the display panel 100. The second common voltage VCOM is applied to the common electrode of the second substrate. The second common voltage VCOM may be transmitted to the first substrate of the display panel 100 through the first signal transmitting line 850 partially overlapping the flexible printed circuit board 800. The second common voltage VCOM may be applied to the common electrode of the second substrate through the connecting part electrically connecting the first and second substrates.

Even though the common voltage compensating part 400 outputs the first common voltage VCST and the second common voltage VCOM in the illustrated exemplary embodiment for the convenience of explanation, the first and second common voltages VCST and VCOM may be the same voltage.

Even though the first common voltage VCST is fed back from the storage electrodes to the switching part 300 in the illustrated exemplary embodiment, the second common voltage VCOM may be fed back from the common electrode to the switching part 300.

The second common voltage VCOM is applied to the common electrode, which is a single, unitary, indivisible member, referred to as a plate type element. In contrast, the first common voltage VCST is sequentially applied to the storage electrodes in the pixels. Accordingly, the transmitting path of the first common voltage VCST may be longer than the transmitting path of the second common voltage VCOM so that a resistance on the transmitting path of the first common voltage VCST may be greater than a resistance on the transmitting path of the second common voltage VCOM. Thus, a ripple of the first common voltage VCST may be maintained longer than a ripple of the second common voltage VCOM. Accordingly, feeding back the first common voltage VCST to compensate the first and second common voltages VCST and VCOM, may be more effective than feeding back the second common voltage VCOM.

Figure 3:
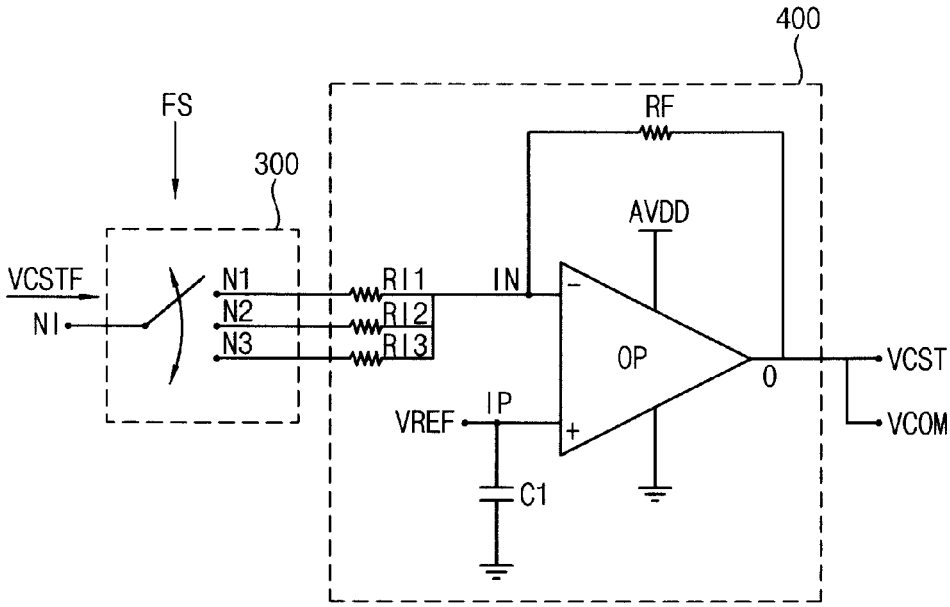
FIG. 3 is a circuit diagram illustrating exemplary embodiments of a switching part and a common voltage compensating part of FIG. 1.

FIG. 3 is a circuit diagram illustrating exemplary embodiments of the switching part 300 and the common voltage compensating part 400 of FIG. 1.

Referring to FIGS. 1 to 3, the switching part 300 includes an input node NI, a first node N1, a second node N2 and a third node N3.

The switching part 300 receives the frequency signal FS from the frequency sensor 210. The feedback common voltage VCSTF is applied to the input node NI of the switching part 300 through the common voltage feedback line VCFL of the display panel 100.

The switching part 300 selectively electrically connects the input node NI to one of the first to third nodes N1, N2 and N3 based on the frequency signal FS.

The common voltage compensating part 400 includes a first input resistor RI1, a second input resistor RI2, a third input resistor RI3, an operational amplifier OP and a feedback resistor RF.

The operational amplifier OP includes a non-inverting input terminal IP, an inverting input terminal IN and an output terminal O.

A first end of the first input resistor RI1 is electrically connected to the first node N1, and a second end of the first input resistor RI1 opposite to the first end is electrically connected to the inverting input terminal IN of the operational amplifier OP. A first end of the second input resistor RI2 is electrically connected to the second node N2, and a second end of the second input resistor RI2 opposite to the first end is electrically connected to the inverting input terminal IN of the operational amplifier OP. A first end of the third input resistor RI3 is electrically connected to the third node N3, and a second end of the third input resistor RI3 opposite to the first end is electrically connected to the inverting input terminal IN of the operational amplifier OP.

A reference common voltage VREF is applied to the non-inverting input terminal IP of the operational amplifier OP. The common voltage compensating part 400 may further include a first capacitor C1 electrically connected to the non-inverting input terminal IP. The first capacitor C1 maintains a level of the reference common voltage VREF.

A first end of the feedback resistor RF is electrically connected to the inverting input terminal IN of the operational amplifier OP, and a second end of the feedback resistor RF is electrically connected to the output terminal O of the operational amplifier OP.

A first driving voltage AVDD driving the operational amplifier OP may be applied to the operational amplifier OP.

A closed loop gain of the operational amplifier OP may be determined by a ratio of an input resistance and a feedback resistance. Equation 1 represents the closed loop gain Av of the operational amplifier OP.

$$Av = -\frac{RF}{RI} \quad \text{[Equation 1]}$$

Herein, RI represents the input resistance, and RF represents the feedback resistance.

Equation 2 represents an output voltage VO of the operational amplifier OP.

$$VO = Av(VP - VN) \quad \text{[Equation 2 ]}$$

Herein, VO represents a voltage at the output terminal O, VP represents a voltage at the non-inverting input terminal IP, and VN represents a voltage at the inverting input terminal IN.

In one exemplary embodiment, for example, when the first common voltage VCST sequentially applied to the storage electrodes in the pixels is increased by rippling, the increased feedback common voltage VCSTF, VN is applied to the inverting input terminal IN through the switching part 300. The operational amplifier OP amplifies a difference between the reference common voltage VREF, VP and the feedback common voltage VCSTF, VN by a negative closed loop gain Av so that the compensated first and second common voltages VCST, VCOM, VO are generated.

The closed loop gain Av of the operational amplifier OP has a negative value so that the operational amplifier OP compensates the first and second common voltages VCST and VCOM applied to the display panel to be decreased when the feedback common voltage VCSTF is greater than the reference common voltage VREF. In contrast, the operational amplifier OP compensates the first and second common voltages VCST and VCOM applied to the display panel to be increased when the feedback common voltage VCSTF is smaller than the reference common voltage VREF.

An absolute value of the closed loop gain Av of the operational amplifier OP may be greater than 1. As the absolute value of the closed loop gain Av of the operational amplifier OP increases, the first and second common voltages VCST and VCOM may be compensated quickly. In one exemplary embodiment, for example, the absolute value of the closed loop gain Av of the operational amplifier OP may be greater than 2.

The input resistance RI of the common voltage compensating part 400 is determined by a switching operation of the switching part 300, and the closed loop gain Av of the operational amplifier OP may be determined by the input resistance RI.

In one exemplary embodiment, for example, when the frequency signal FS transmitted to the switching part 300 represents the first frequency, the switching part 300 connects the input node NI of the switching part 300 to the first node N1. Equation 3 represents a closed loop gain Av1 of the operational amplifier OP when the input node NI is connected to the first node N1.

$$Av1 = -\frac{RF}{RI1} \quad \text{[Equation 3]}$$

In one exemplary embodiment, for example, when the frequency signal FS transmitted to the switching part 300 represents the second frequency, the switching part 300 connects the input node NI of the switching part 300 to the second node N2. Equation 4 represents a closed loop gain Av2 of the operational amplifier OP when the input node NI is connected to the second node N2.

$$Av2 = -\frac{RF}{RI2} \quad \text{[Equation 4]}$$

In one exemplary embodiment, for example, when the frequency signal FS transmitted to the switching part 300 represents the first frequency, the switching part 300 connects the input node NI of the switching part 300 to the third node N3. Equation 5 represents a closed loop gain Av3 of the operational amplifier OP when the input node NI is connected to the third node N3.

$$Av3 = -\frac{RF}{RI3} \quad \text{[Equation 5]}$$

When the frequency of the display panel 100 increases, the first and second common voltages VCST and VCOM should be compensated quickly so that an absolute value of the closed loop gain Av of the operational amplifier OP should be increased.

Thus, when the frequency of the display panel 100 increases, the selected input resistance RI should be decreased.

In one exemplary embodiment, for example, when the first frequency is the smallest among the first to third frequencies and the third frequency is the greatest among the first to third frequencies, the first input resistance RI1 may be the greatest among the first to third input resistances RI1 to RI3 and the third input resistance RI3 may be the smallest among the first to third input resistances RI1 to RI3.

In the illustrated exemplary embodiment explained referring to FIG. 3, though the frequency of the display panel 100 has three possibilities, and the input resistance includes the first to third input resistances RI1, RI2 and RI3, the invention is not limited thereto.

Figure 4:
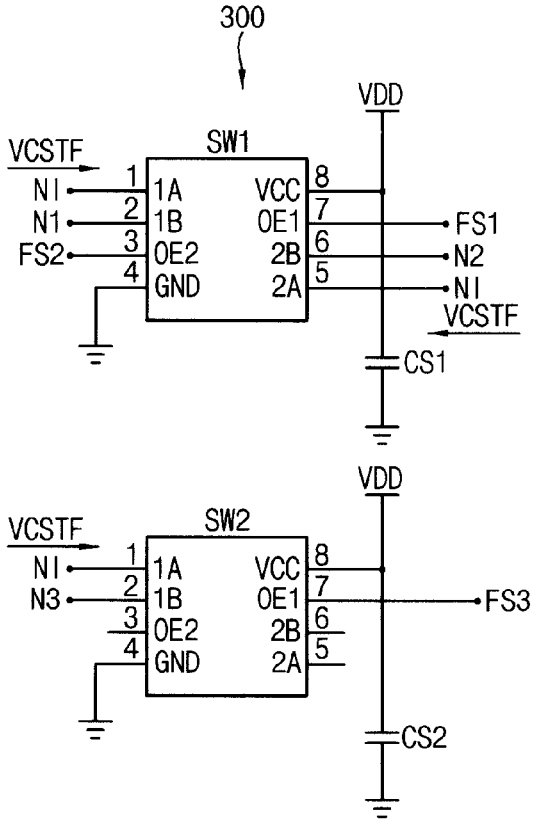
FIG. 4 is a circuit diagram illustrating the switching part of FIG. 3.

FIG. 4 is a circuit diagram illustrating the switching part 300 of FIG. 3.

Referring to FIGS. 3 and 4, the switching part 300 includes a first analog switch SW1 and a second analog switch SW2.

The first and second analog switches SW1 and SW2 respectively include eight terminals numbered 1 to 8 in FIG. 4. A first terminal may be a first switch input terminal 1A. A second terminal may be a first switch output terminal 1B. A third terminal may be a second enable terminal OE2. A fourth terminal may be a ground terminal GND. A fifth terminal may be a second switch input terminal 2A. A sixth terminal may be a second switch output terminal 2B. A seventh terminal may be a first enable terminal OE1. An eighth terminal may be a voltage source terminal VCC.

The frequency signal FS may include a first frequency signal FS1, a second frequency signal FS2 and a third frequency signal FS3. The first to third frequency signals FS1, FS2 and FS3 may respectively represents ON and OFF values. In one exemplary embodiment, for example, when the frequency of the display panel 100 is a first frequency, the first frequency signal FS1 represents ON value. When the frequency of the display panel 100 is not the first frequency, the first frequency signal FS1 represents OFF value. When the frequency of the display panel 100 is a second frequency, the second frequency signal FS2 represents ON value. When the frequency of the display panel 100 is not the second frequency, the second frequency signal FS2 represents OFF value. When the frequency of the display panel 100 is a third frequency, the third frequency signal FS3 represents ON value. When the frequency of the display panel 100 is not the third frequency, the third frequency signal FS3 represents OFF value.

A second driving voltage VDD is applied to the voltage source terminals VCC of the first and second analog switches SW1 and SW2. A ground voltage is applied to the ground terminals GND of the first and second analog switches SW1 and SW2. First and second storage capacitors CS1 and CS2 to maintain a level of the second driving signal VDD may be connected to the voltage source terminals VCC of the first and second analog switches SW1 and SW2.

The input node NI of the switching part 300 is connected to the first and second switch input terminals 1A and 2A of the first analog switch SW1, and to the first switch input terminal 1A of the second analog switch SW2. The feedback common voltage VCSTF is applied to the first and second switch input terminals 1A and 2A of the first analog switch SW1, and to the first switch input terminal 1A of the second analog switch SW2.

The first frequency signal FS1 is applied to the first enable terminal OE1 of the first analog switch SW1. The second frequency signal FS2 is applied to the second enable terminal OE2 of the first analog switch SW1. The third frequency signal FS3 is applied to the first enable terminal OE1 of the second analog switch SW1.

The first node N1 is electrically connected to the first switch output terminal 1B of the first analog switch SW1. The second node N2 is electrically connected to the second switch output terminal 2B of the first analog switch SW1. The third node N3 is electrically connected to the first switch output terminal 1B of the second analog switch SW2.

When the first frequency signal FS1 represents ON, and the second and third frequency signals FS2 and FS3 represent OFF, the switching part 300 electrically connects the first switch input terminal 1A of the first analog switch SW1 to the first switch output terminal 1B of the first analog switch SW1 to apply the feedback common voltage VCSTF to the first node N1.

When the second frequency signal FS2 represents ON, and the first and third frequency signals FS1 and FS3 represent OFF, the switching part 300 electrically connects the second switch input terminal 2A of the first analog switch SW1 to the second switch output terminal 2B of the first analog switch SW1 to apply the feedback common voltage VCSTF to the second node N2.

When the third frequency signal FS3 represents ON, and the first and second frequency signals FS1 and FS2 represent OFF, the switching part 300 electrically connects the first switch input terminal 1A of the second analog switch SW2 to the first switch output terminal 1B of the second analog switch SW2 to apply the feedback common voltage VCSTF to the third node N3.

In the illustrated exemplary embodiment, though the switching part 300 includes two analog switches SW1 and SW2, the invention may include a single analog switch which has terminals more than the analog switches SW1 and SW2. The switching part 300 may include a multiplexer. The switching part 300 is not limited to the above exemplary embodiments. The switching part 300 may be designed by a various method.

Figure 5:
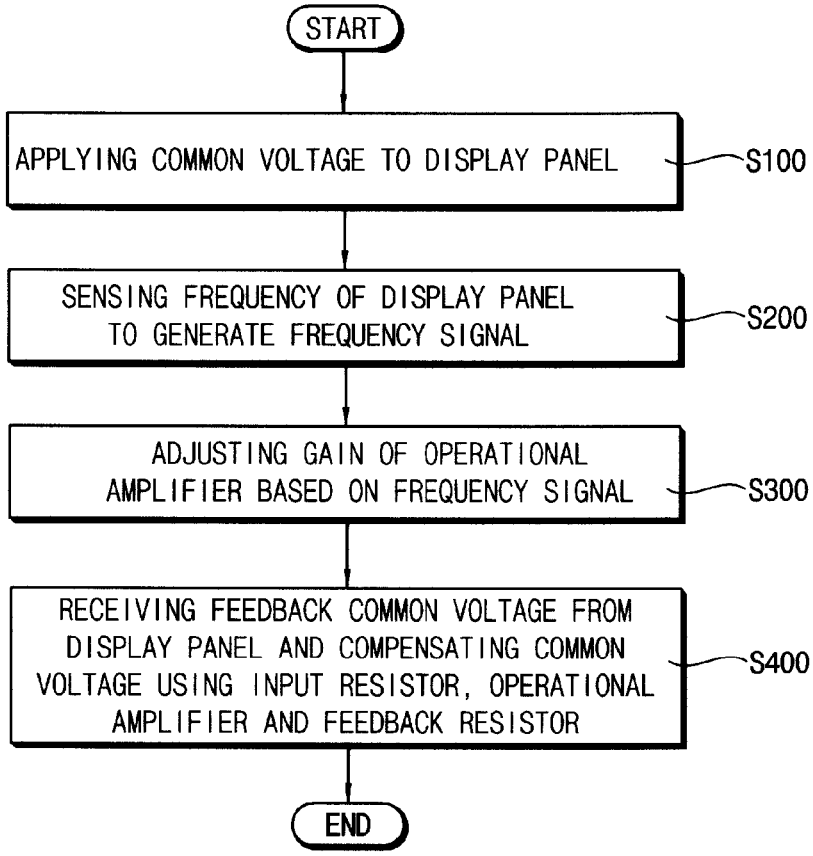
FIG. 5 is a flowchart illustrating an exemplary embodiment of a method of driving the display panel of FIG. 1.

FIG. 5 is a flowchart illustrating an exemplary embodiment of a method of driving the display panel 100 of FIG. 1.

Referring to FIGS. 1 and 5, the common voltage compensating part 400 applies the first and second common voltages VCST and VCOM to the display panel 100 (step S100).

The frequency sensor 210 senses a frequency of the display panel 100 to generate a frequency signal FS (step S200).

The switching part 300 receives the frequency signal FS from the frequency sensor 210. The switching part 300 adjusts a gain of an operational amplifier of the common voltage compensating part 400 based on the frequency signal FS (step S300).

The common voltage compensating part 400 includes the operational amplifier, and the input resistor and the feedback resistor which are electrically connected to the operational amplifier.

The common voltage compensating part 400 receives the feedback common voltage VCSTF from the display panel 100. The common voltage compensating part 400 compensates the first and second common voltages VCST and VCOM to be applied to the display panel 100 using the operational amplifier the input resistor and the feedback resistor (step S400). The common voltage compensating part 400 applies the compensated first and second common voltages VCST and VCOM to the display panel 100.

According to the illustrated exemplary embodiment explained referring to FIGS. 1 to 5, the gain of the operational amplifier of the common voltage compensating part 400 may be adjusted by selecting the input resistance RI according to a frequency of the display panel 100. Thus, a display quality of the display panel 100 may be improved.

Figure 6:
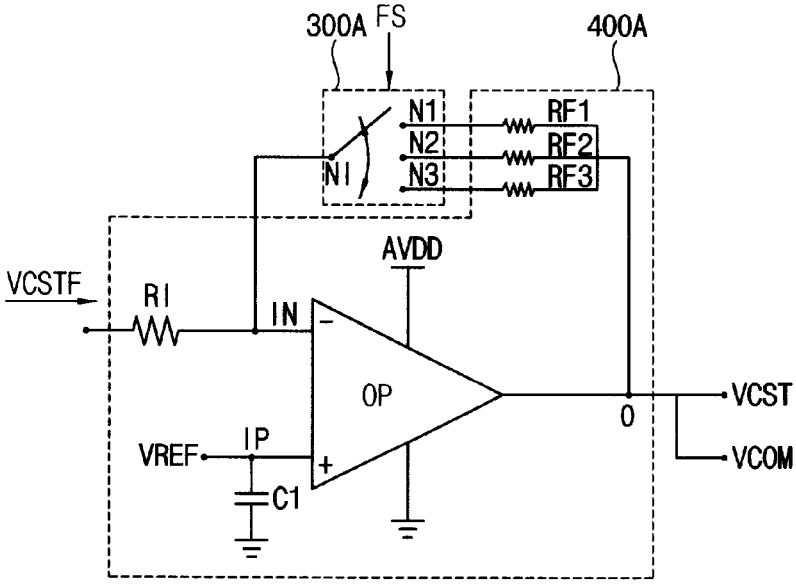
FIG. 6 is a circuit diagram illustrating other exemplary embodiments of a switching part and a common voltage compensating part according to the invention.

FIG. 6 is a circuit diagram illustrating another exemplary embodiment of a switching part 300A and a common voltage compensating part 400A according to the invention.

The display apparatus according to the illustrated exemplary embodiment is substantially the same as the display apparatus according to the previous exemplary embodiment of FIGS. 1 to 4, except for the switching part 300A and the common voltage compensating part 400A. Thus, the same reference numerals will be used to refer to the same or like parts as those described in the previous exemplary embodiment of FIGS. 1 to 4 and any repetitive explanation concerning the above elements will be omitted.

The method of driving the display panel 100 according to the illustrated exemplary embodiment is substantially the same as the method of driving the display panel according to the previous exemplary embodiment of FIG. 5. Thus, the same reference numerals will be used to refer to the same or like parts as those described in the previous exemplary embodiment of FIG. 5 and any repetitive explanation concerning the above elements will be omitted.

Referring to FIGS. 1, 2 and 6, the feedback common voltage VCSTF is directly applied from the display panel 100 to the common voltage compensating part 400A without passing the switching part 300A.

The switching part 300A includes the input node NI, the first node N1, the second node N2 and the third node N3.

The switching part 300A receives the frequency signal FS from the frequency sensor 210. The switching part 300A electrically connects the input node NI to one of the first to third nodes N1, N2 and N3 based on the frequency signal FS.

The common voltage compensating part 400A includes an input resistor RI, the operational amplifier OP, a first feedback resistor RF1, a second feedback resistor RF2 and a third feedback resistor RF3.

The operational amplifier OP includes the non-inverting input terminal IP, the inverting input terminal IN and the output terminal O.

The feedback common voltage VCSTF is applied to a first end of the input resistor RI, and a second end of the first input resistor RI opposite to the first end is electrically connected to the inverting input terminal IN of the operational amplifier OP.

The inverting input terminal IN of the operational amplifier OP is electrically connected to the input node NI of the switching part 300A.

A reference common voltage VREF is applied to the non-inverting input terminal IP of the operational amplifier OP. The common voltage compensating part 400A may further include a first capacitor C1 electrically connected to the non-inverting input terminal IP. The first capacitor C1 maintains a level of the reference common voltage VREF.

A first end of the first feedback resistor RF1 is electrically connected to the first node N1, and a second end of the first feedback resistor RF1 opposite to the first end is electrically connected to the output terminal O of the operational amplifier OP. A first end of the second feedback resistor RF2 is electrically connected to the second node N2, and a second end of the second feedback resistor RF2 opposite to the first end is electrically connected to the output terminal O of the operational amplifier OP. A first end of the third feedback resistor RF3 is electrically connected to the third node N3, and a second end of the third feedback resistor RF3 opposite to the first end is electrically connected to the output terminal O of the operational amplifier OP.

The first driving voltage AVDD driving the operational amplifier OP the may be applied to the operational amplifier OP.

The feedback resistance RF of the common voltage compensating part 400A is determined by a switching operation of the switching part 300A, and the closed loop gain Av of the operational amplifier OP may be determined by the feedback resistance RF.

In one exemplary embodiment, when the frequency signal FS transmitted to the switching part 300A represents the first frequency, the switching part 300A connects the input node NI of the switching part 300A to the first node N1. Equation 6 represents a closed loop gain Av1 of the operational amplifier OP when the input node NI is connected to the first node N1.

$$Av1 = -\frac{RF1}{RI} \quad \text{[Equation 6]}$$

In one exemplary embodiment, for example, when the frequency signal FS transmitted to the switching part 300A represents the second frequency, the switching part 300A connects the input node N1 of the switching part 300A to the second node N2. Equation 7 represents a closed loop gain Av2 of the operational amplifier OP when the input node N1 is connected to the second node N2.

$$Av2 = -\frac{RF2}{RI} \quad \text{[Equation 7]}$$

In one exemplary embodiment, for example, when the frequency signal FS transmitted to the switching part 300A represents the third frequency, the switching part 300A connects the input node NI of the switching part 300A to the third node N3. Equation 8 represents a closed loop gain Av3 of the operational amplifier OP when the input node NI is connected to the third node N3.

$$Av3 = -\frac{RF3}{RI} \quad \text{[Equation 8]}$$

When the frequency of the display panel 100 increases, the first and second common voltages VCST and VCOM should be compensated quickly so that an absolute value of the closed loop gain Av of the operational amplifier OP should be increased.

Thus, when the frequency of the display panel 100 increases, the selected feedback resistance RF should be increased.

In one exemplary embodiment, for example, when the first frequency is the smallest among the first to third frequencies, and the third frequency is the greatest among the first to third frequencies, the first feedback resistance RF1 may be the smallest among the first to third feedback resistances RF1 to RF3, and the third feedback resistance RF3 may be the greatest among the first to third feedback resistances RF1 to RF3.

In the illustrated exemplary embodiment explained referring to FIG. 6, though the frequency of the display panel 100 has three possibilities, and the feedback resistance includes the first to third feedback resistances RF1, RF2 and RF3, the invention is not limited thereto.

According to the illustrated exemplary embodiment explained referring to FIG. 6, the gain of the operational amplifier of the common voltage compensating part 400A may be adjusted by selecting the feedback resistance RF according to a frequency of the display panel 100. Thus, a display quality of the display panel 100 may be improved.

As explained above, according to the illustrated exemplary embodiment, a common voltage is compensated according to a frequency of a display panel 100 so that a display quality of the display panel 100 may be improved The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of driving a display panel, the method comprising:

applying a common voltage to the display panel;

sensing a frequency of the display panel and generating a frequency signal based on the sensed frequency;

adjusting a gain of an operational amplifier based on the frequency signal;

receiving a feedback common voltage from the display panel; and compensating the common voltage using an input resistor, the operational amplifier and a feedback resistor based on the feedback common voltage, and applying the compensated common voltage to the display panel, wherein the operational amplifier includes:

an inverting input terminal connected to the input resistor, a non-inverting input terminal to which a reference common voltage is applied; and an output terminal, the feedback resistor being between the inverting input terminal and the output terminal.

2. The method of claim 1, wherein the adjusting a gain of an operational amplifier includes selecting one of a plurality of input resistors based on the frequency signal.

3. The method of claim 2, wherein the selected input resistor has a relatively low resistance when the frequency of the display panel is relatively high.

4. The method of claim 2, wherein the adjusting a gain of an operational amplifier includes connecting a switch input terminal, to which the feedback common voltage is applied, to a switch output terminal when the frequency signal represents ON value applied to an enable terminal.

5. The method of claim 1, wherein the adjusting a gain of an operational amplifier includes selecting one of a plurality of feedback resistors based on the frequency signal.

6. The method of claim 5, wherein the selected feedback resistor has a relatively high resistance when the frequency of the display panel is relatively high.

7. The method of claim 5, wherein the adjusting a gain of the operational amplifier includes connecting a switch input terminal, to which the feedback common voltage is applied, to a switch output terminal when the frequency signal represents ON value applied to an enable terminal.

8. The method of claim 1, further comprising providing the feedback common voltage from a storage electrode of the display panel before the receiving a feedback common voltage.

9. The method of claim 1, further comprising the display panel selectively displaying a two-dimensional image and a three-dimensional image.

10. The method of claim 9, wherein the frequency of the display panel is about 60 Hertz or about 120 Hertz when the display panel displays the two-dimensional image, and the frequency of the display panel is about 175 Hertz when the display panel displays the three-dimensional image.

11. A display apparatus comprising:

a display panel which displays an image;

a frequency sensor which senses a frequency of the display panel and generates a frequency signal based on the sensed frequency;

a common voltage compensating part including an input resistor, an operational amplifier and a feedback resistor, receiving a feedback common voltage from the display panel, and compensating the common voltage, the operational amplifier including:

an inverting input terminal connected to the input resistor, a non-inverting input terminal to which a reference common voltage is applied; and an output terminal, the feedback resistor being between the inverting input terminal and the output terminal; and a switching part which selects the input resistor or the feedback resistor based on the frequency signal, and adjusts a gain of the operational amplifier of the common voltage compensating part.

12. The display apparatus of claim 11, wherein the switching part selects one of a plurality of input resistors based on the frequency signal.

13. The display apparatus of claim 12, wherein the selected input resistor has a relatively low resistance when the frequency of the display panel is relatively high.

14. The display apparatus of claim 12, wherein the switching part includes an enable terminal, a switch input terminal and a switch output terminal, the frequency signal is applied to the enable terminal, the feedback common voltage is applied to the switch input terminal, and the switch input terminal is connected to the switch output terminal when the frequency signal represents ON value.

15. The display apparatus of claim 11, wherein the switching part selects one of a plurality of feedback resistors based on the frequency signal.

16. The display apparatus of claim 15, wherein the selected feedback resistor has a relatively high resistance when the frequency of the display panel is relatively high.

17. The display apparatus of claim 15, wherein the switching part includes an enable terminal, a switch input terminal and a switch output terminal, the frequency signal is applied to the enable terminal, the feedback common voltage is applied to the switch input terminal, and the switch input terminal is connected to the switch output terminal when the frequency signal represents ON value.

18. The display apparatus of claim 11, wherein the display panel comprises a first substrate including a pixel electrode and a storage electrode, and a second substrate including a common electrode, and the feedback common voltage is provided from the storage electrode to the common voltage compensating part.

19. The display apparatus of claim 11, wherein the display panel selectively displays a two-dimensional image and a three-dimensional image.

20. The display apparatus of claim 19, wherein the frequency of the display panel is about 60 Hertz or about 120 Hertz when the display panel displays the two-dimensional image, and the frequency of the display panel is about 175 Hertz when the display panel displays the three-dimensional image.

* * * * *